US007021508B1

(12) United States Patent
Aston

(10) Patent No.: US 7,021,508 B1
(45) Date of Patent: Apr. 4, 2006

(54) EXTERNAL FRAME BACKPACK

(76) Inventor: Kevin Aston, 117 Skyline Dr., Eau Claire, WI (US) 54703

( * ) Notice: Subject to any disclaimer, the term of this patent is extended or adjusted under 35 U.S.C. 154(b) by 144 days.

(21) Appl. No.: 10/400,016

(22) Filed: Mar. 25, 2003

(51) Int. Cl.
*A45F 3/04* (2006.01)
*A45F 3/08* (2006.01)
*A45F 3/10* (2006.01)

(52) U.S. Cl. ..... 224/628; 224/366; 224/637

(58) Field of Classification Search ..... 224/153, 224/261, 262, 533, 536, 628, 637, 263
See application file for complete search history.

(56) References Cited

U.S. PATENT DOCUMENTS

| | | | | | |
|---|---|---|---|---|---|
| 2,421,244 | A | | 5/1947 | Daiber | |
| 3,206,087 | A | * | 9/1965 | Tyrreli | 224/636 |
| 3,219,243 | A | * | 11/1965 | Mack et al. | 224/262 |
| 3,355,075 | A | | 11/1967 | Dean | |
| 3,581,961 | A | * | 6/1971 | Owens | 224/262 |
| 4,099,657 | A | | 7/1978 | Zufich | |
| 4,189,076 | A | | 2/1980 | Zufich | |
| 4,194,656 | A | | 3/1980 | Zufich | |
| 4,582,165 | A | | 4/1986 | Latini | |
| 4,776,503 | A | * | 10/1988 | Sink | 224/153 |
| 4,842,173 | A | * | 6/1989 | Scherer | 224/631 |
| 4,858,797 | A | * | 8/1989 | Rabska | 224/162 |
| 4,934,573 | A | | 6/1990 | Jaeger | |
| D311,094 | S | * | 10/1990 | Scherer | D3/216 |
| 5,131,575 | A | | 7/1992 | Charest | |
| 5,381,941 | A | * | 1/1995 | Brune | 224/155 |
| 5,503,314 | A | * | 4/1996 | Fiscus | 224/665 |
| 5,553,759 | A | | 9/1996 | McMaster et al. | |
| 5,564,612 | A | * | 10/1996 | Gregory | 224/633 |
| 5,586,699 | A | * | 12/1996 | Heisler et al. | 224/628 |
| 5,588,570 | A | * | 12/1996 | Zirbel | 224/155 |
| 5,762,243 | A | | 6/1998 | McMaster et al. | |
| 5,762,251 | A | | 6/1998 | Gleason | |
| 5,836,489 | A | | 11/1998 | Swetish | |
| 5,868,462 | A | | 2/1999 | Truax | |
| 5,904,282 | A | | 5/1999 | Gleason | |
| 5,954,253 | A | | 9/1999 | Swetish | |
| 6,015,076 | A | * | 1/2000 | Pennington | 224/637 |
| 6,179,188 | B1 | | 1/2001 | Gleason | |
| 6,681,973 | B1 | * | 1/2004 | Crumrine | 224/637 |
| 6,722,543 | B1 | * | 4/2004 | Fitzgerald et al. | 224/583 |

OTHER PUBLICATIONS

WWW.BULLPACS.COM, Welcome to BULL-PACS—Premium Pack Frames For Hunters, Website display and photographs, publication unknown, date of transmission Mar. 12, 2003 ( 2 pages).

WWW.GREGORYPACKS.COM, Gregory Mountain Products, Website display and photographs, publication unknown, date of transmission Mar. 25, 2003 (1 page).

* cited by examiner

*Primary Examiner*—Sue A. Weaver
(74) *Attorney, Agent, or Firm*—Anthony J. Bourget

(57) ABSTRACT

An external frame backpack comprising two spaced-apart substantially rigid frame side posts, a substantially rigid cargo shelf integrally connected to the side posts, a substantially rigid upper cross member secured between the side posts, a substantially rigid lower hip plate secured between the side posts, and a flexible hip belt rigidly fastened to the hip plate. In another aspect disclosed herein, the hip belt comprises left and right wings, each wing fastened to the hip plate through at least two vertically separated apertures defined by the hip plate.

25 Claims, 6 Drawing Sheets

EXTERNAL FRAME BACKPACK

FIELD OF THE INVENTION

This invention relates to backpacks and backpack frames for carrying loads, and more particularly to an external frame backpack and backpack system.

DESCRIPTION—BACKGROUND OF INVENTION

A variety of types of backpacks exist, including those generally known as internal frame or self-contained backpacks, and external frame backpacks. External frame backpacks are particularly well suited for carrying heavy, awkward, or irregular shaped loads. With external backpack systems the load does not necessarily need to be contained to a confined area such as those used in an internal frame or contained backpack. Heavy and bulky loads can be tied down on external frame backpacks conveniently.

One drawback with such external backpacks is that due to the heavy or awkward loads, the user often experiences difficulty in controlling the backpack. A heavy load, especially when carried over long distances or about difficult terrain, tends to cause a backpack to slip or sag upon the user. A common occurrence when the backpack sags upon the user's hips is that extra forces are then needed to be absorbed at the shoulder strap location or at other portions upon the back of the user. Ideally the load is secured primarily at the hip location of the user which allows for proper center of gravity placement, better load bearing strength, and improved control of a loaded backpack.

External frames have been very popular for many years; however, the development of improved internal frame structures has led to a decline in use of external frame systems. Nonetheless, the external frame system has many advantages over internal frames. The external frame allows a more efficient transfer of weight from the back to the shoulders and hips of the user. The frame can be used with a pack to contain standard gear, or may be used with simply the frame to carry odd shapes or very heavy and dense objects such as crates or water cans or even game.

With the more current use of internal frame systems, advanced high tech designs and materials have been utilized. The success of internal frame systems has led designers to create external frame systems that use internal frame technologies. This has led to the current systems being complicated and expensive.

A need exists for a simple, efficient system that is flexible in its use and has components that integrate with other components to form subsystems for backpackers. The external frame is the preferred system because of the inherent load carrying capabilities.

Major drawbacks of current external frame systems involve complicated and expensive structures. A further drawback is that the present external systems do not adequately secure the load and frame of the backpack at the hips of the user. Throughout normal use of walking with a backpack over rugged terrain or even over simple terrain if carrying a heavy load a great distance results in the backpack beginning to sag from the user. The sagging backpack causes discomfort and makes the use of the backpack more and more difficult. Drawbacks of the complex systems include lack of easily replaceable or interchangeable components such as shoulder straps that can be used on either left or right side or hip belt wings that can be used on either side of the frame.

It is thus an object of the present invention to provide alternative external frame backpack that overcomes the drawbacks and limitations of present backpacks and backpack systems.

It is also an object of the present invention to provide an external frame backpack that secures to the hips of the user without undue loosening or sag thereby allowing the user to support the load primarily at the center of gravity.

It is also an object of the present invention to provide an external frame backpack that minimizes weight or stress upon the user's shoulders.

It is also an object of the present invention to provide an external frame backpack that is capable of supporting large load capacities while allowing the user to maintain enhanced control of the backpack.

It is also an object of the present invention to provide an external frame backpack having a rigid hip belt-to-frame attachment that results in an even distribution of weight or forces onto the hips.

It is also an object of the present invention to provide an external frame backpack having a hip pad having minimal load bearing function.

These and other objects of the invention will become apparent in light of the present specification.

BRIEF SUMMARY OF THE INVENTION

The present invention is directed to an external frame backpack. One embodiment is directed to an external frame backpack comprising two spaced-apart substantially rigid frame side posts, a substantially rigid cargo shelf integrally connected to the two side posts, a substantially rigid upper cross member secured between the side posts, a substantially rigid lower hip plate secured between the side posts, and a flexible hip belt rigidly fastened to the hip plate. Another aspect includes the hip belt comprising left and right wings, each wing fastened to the hip plate through at least two vertically separated apertures defined by the hip plate.

A further embodiment is directed to an external frame backpack for use in carrying heavy loads during which the backpack is secured about the hips and over the shoulders of a user and is subjected to movement forces about the hips and over the shoulders in relation to the motion of the user, the backpack comprising two spaced-apart substantially rigid frame side posts, a substantially rigid cargo shelf integrally connected to the two side posts, a substantially rigid upper cross member secured between the side posts, the upper cross member including apertures for receiving shoulder straps, a substantially rigid lower hip plate secured between the side posts, and a hip belt rigidly fastened to the hip plate whereby during user motion sagging of the backpack about the hips is obviated due to the hip belt being rigidly fastened to the hip plate thereby contributing to obviating sagging of the backpack and corresponding shoulder strap gouging.

A further embodiment is directed to an external frame backpack comprising two spaced-apart substantially rigid frame side posts, a substantially rigid cargo shelf integrally connected to the two side posts, a substantially rigid upper cross member secured between the side posts, a substantially rigid and generally rectangular lower hip plate secured between the side posts, the hip plate having an upper edge portion and a lower edge portion, and a hip belt rigidly fastened to the hip plate with at least two fasteners, each of the fasteners includes one selected from the group consisting of a bolt and a rivet, at least one of the fasteners is fastened to the hip plate at the upper edge portion and at least another of the fasteners is fastened to the hip plate at the lower edge portion.

DETAILED DESCRIPTION OF THE PREFERRED EMBODIMENTS

Figure 1:
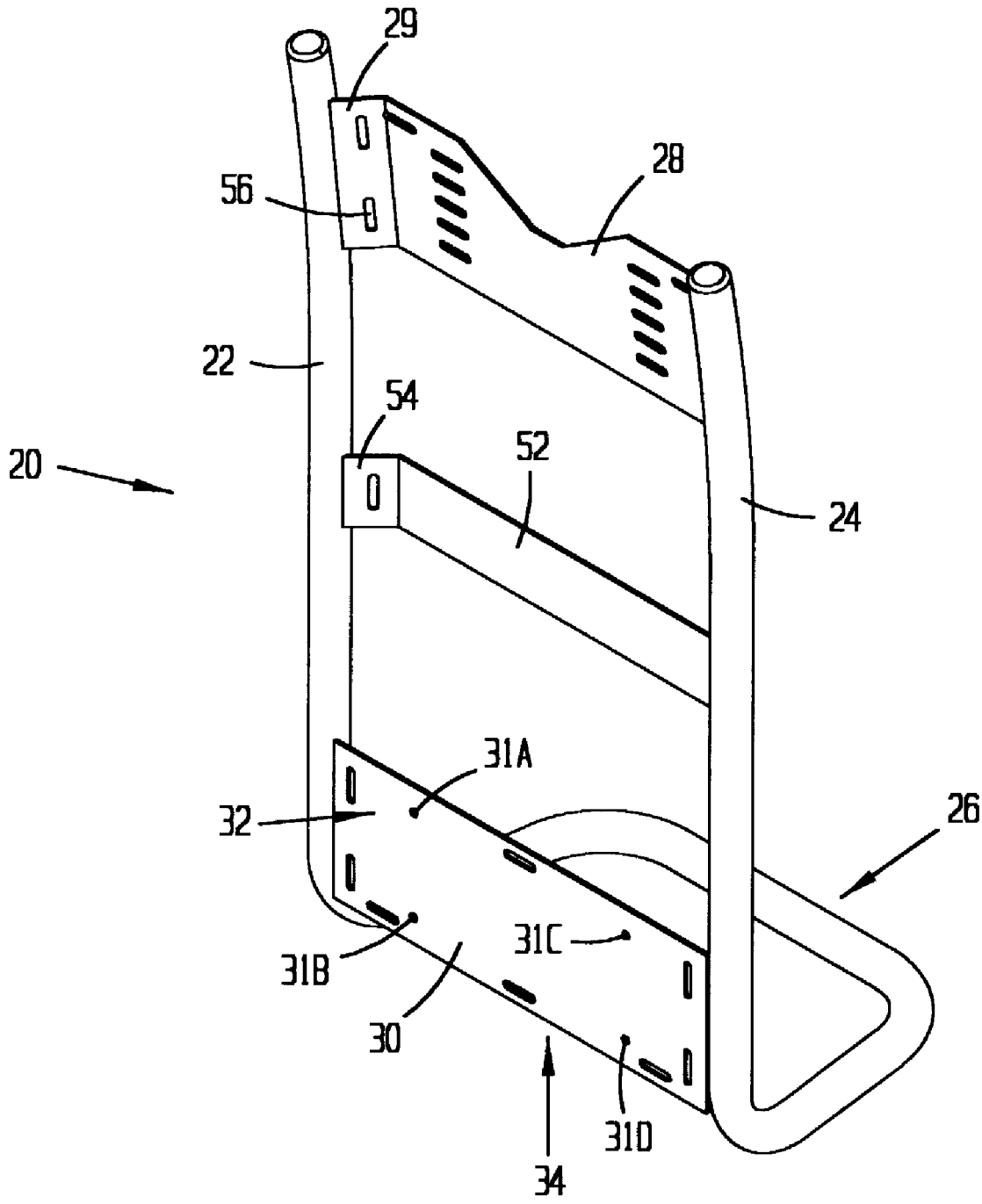
FIG. 1 is a perspective view of the external frame backpack of the present invention, absent a hip belt.

Referring now to the Figures, the preferred embodiments of the external frame backpack of the present invention will be described. A backpack 20 of the type generally used on the back of a hiker (hiker not shown) is provided. Backpack 20 includes two spaced-apart substantially rigid side posts, 22, 24. Left side post 22, and right side post 24 are generally parallel to each other. Side posts 22, 24, are generally vertically orientated when backpack 20 is on the back of a user. Side post 22, 24 may be constructed of aluminum, other metals, composite materials, or other suitable materials. Backpack 20 includes a substantially rigid cargo shelf 26. As shown, cargo shelf 26 is preferably integrally connected to the left side post 22 and right side post 24. Preferably, left side post 22 and right side post 24 extend from near the shoulders of a user to just below the back of the user. Preferably, cargo shelf 26 is an integrally bent portion of left side post 22 and right side post 24 which are thus formed from the same piece of tubular aluminum resulting in a generally U-shape. Cargo shelf 26 generally extends outward from side post 22 and 24 and is generally perpendicular to side post 22 and 24. Items to be carried may be supported upon the cargo shelf 26 or carried beneath cargo shelf 26.

Cross member 28 extends near the upper portions of side post 22 and 24 in a generally horizontal fashion. Upper cross member 28 is preferably made of an aluminum construction or other metals, composite materials, or other suitable materials. Upper cross member 28 includes slots 48 for receiving shoulder straps 50. Preferably, upper cross member 28 is secured to the external frame backpack 20 by welding. Further, upper cross member 28 is preferably constructed of flattened stock as opposed to rounded stock to accommodate for attachment of items to be carried or for a sack to be tied to upper cross member 28. Upper cross member 28 includes upper cross member flange 29, on either end of cross member 28. Flanges 29 accommodate for upper cross member 28 to be recessed or offset away from the back of the user and project toward the direction of cargo shelf 26. The use of flanges 29 allow for the cargo items to be removed from direct contact with the hiker while providing rigid support. Having cross member 28 offset by use of flanges 29 allows the backpack 20 to follow a more natural curve of the user's back while also allowing for ventilation space. Slightly removing the load from contacting the user's back allows for a more comfortable experience, lessens heat transfer and reduces possibilities for abrasion. Tie down openings 56 are also provided in upper cross member flanges 29 and cross member 28.

Middle cross member 52 extends near the midpoints of side posts 22, 24 in a generally horizontal manner as shown. Middle cross member flanges 54 are included to provide offset positioning of middle cross member 52. Such offset accommodates for comfortable use as described above with respect to the recess of upper cross member 28. In operation a user may include a middle cross member pad (not shown) attached to cross member 52. Offset flanges 54 are preferably positioned to accommodate use of a middle cross member pad such that the middle cross member pad comfortably cushions the back of a user. Tie down opening 56 are also provided in flanges 54 and middle cross member 52.

Lower hip plate 30 extends from near the lower ends of side post 22, 24. Preferably, hip plate 30 is welded into position. Preferably, lower hip plate 30 is positioned at the centerline of side posts 22, 24, and is not recessed as is the upper cross member 28 and middle cross member 52. Preferably, hip plate 30 defines a vertically oriented hip plate plane different from an upper cross member plane defined by the upper cross member 28 and different from a middle cross member plane defined by middle cross member 52. Preferably, each plane defined by the hip plate 30, upper cross member 28, and middle cross member 52 are different. It can be appreciated that the plane defined by upper cross member 28 is angled with respect to the plane defined by hip plate 30 due to the curvature of side posts 22, 24. Such curvature allows for a more natural following of a user's back. It can also be appreciated that the plane defined by middle cross member 52 is different than the plane defined by upper cross member 28.

Lower hip plate 30 may be constructed of aluminum, other metals, composite materials, or other suitable materials and should be substantially rigid. Preferably, hip plate 30 is of a generally rectangular shape. Hip plate 30 is also substantially flat, and is preferably non-curved (i.e., does not bow or extend rearward beyond side posts 22, 24).

As shown in FIG. 1, Hip plate 30 includes an upper edge portion 32 and a lower edge portion 34. Hip belt 40 is secured to hip plate 30. It may be appreciated that hip belt 40 may be of a single piece or singular construction, but in the preferred embodiment consists of left hip wing 44 and right hip wing 46. Width B (See FIG. 2) of the hip belt 40 should be of dimension sufficient to accommodate securing about the hips of a user and preferably measures about 6 inches in width. Preferably, hip plate 30 has a comparable width dimension B to accommodate secure vertically-rigid fastening of hip belt 40 described herein.

Hip belt 40 is fastened to hip plate 30 with fasteners 36. At least two fasteners 36 are used to achieve rigid fastening, particularly to achieve a vertically-rigid fastened configuration as shown. Preferably, fasteners 36 are positioned vertically as shown so as to prohibit hip belt 40 from compressing, flexing, or otherwise vertically deforming which would result in sagging of backpack 20 about the hips of a user. Hip belt 40 is preferably made of a strong and flexible polymer construction. Polymer construction allows the hip belt to curve around the hips in a uniform manner. Hip belt 40 should be of sufficient thickness to withstand vertical deformities near the points or portions of contact adjacent the fasteners 36.

In a preferred embodiment, hip belt 40 is fastened to hip plate 30 with at least two fasteners (such as, for instance, 36*a* and 36*b*). At least one of the fasteners, (for instance 36*a*), is fastened adjacent the upper edge portion 32, and at least another of the fasteners, (for instance, 36*b*), is fastened adjacent the lower edge portion 34.

Preferably, hip belt includes a left hip wing 44 and right hip wing 46. Each of the hip wings 44, 46 is rigidly fastened to the hip plate 30. Such rigid fastening is obtained by use of at least two fasteners positioned vertically as described above. Fasteners 36 may include general bolts and rivets. Washers 38 may be utilized in conjunction with the fasteners 36 as needed and to accommodate for additional rigid fastening. A combination of bolts and rivets can be utilized.

Preferably, the fasteners 36 of left hip wing 44 and right hip wing 46 are spaced apart from each other sufficient to accommodate for comfortable wrapping of hip belt 40 about the hips of the user. If left hip wing 44 and right hip wing 46 are positioned too close to each other, then tightening of hip belt 40 around the waist of the user would tend to unduly constrain the user at the waist, causing additional and needless discomfort without a corresponding load bearing benefit. If left hip wing 44 and right hip wing 46 are positioned at too great a distance, the benefits of wrapping about the user's waist are diminished since such configuration may tend to provide gaps which would increase slippage or sagging of the backpack 20. Applicant has found it preferable to space fasteners 36*a*, 36*b*, of left hip wing 44 at least about 7 inches apart from fasteners 36*c*, 36*d* of right hip wing 46. The spacing is preferably about 3.5 inches from the midline of the hip plate 30 on each side of hip plate 30.

Figure 5:
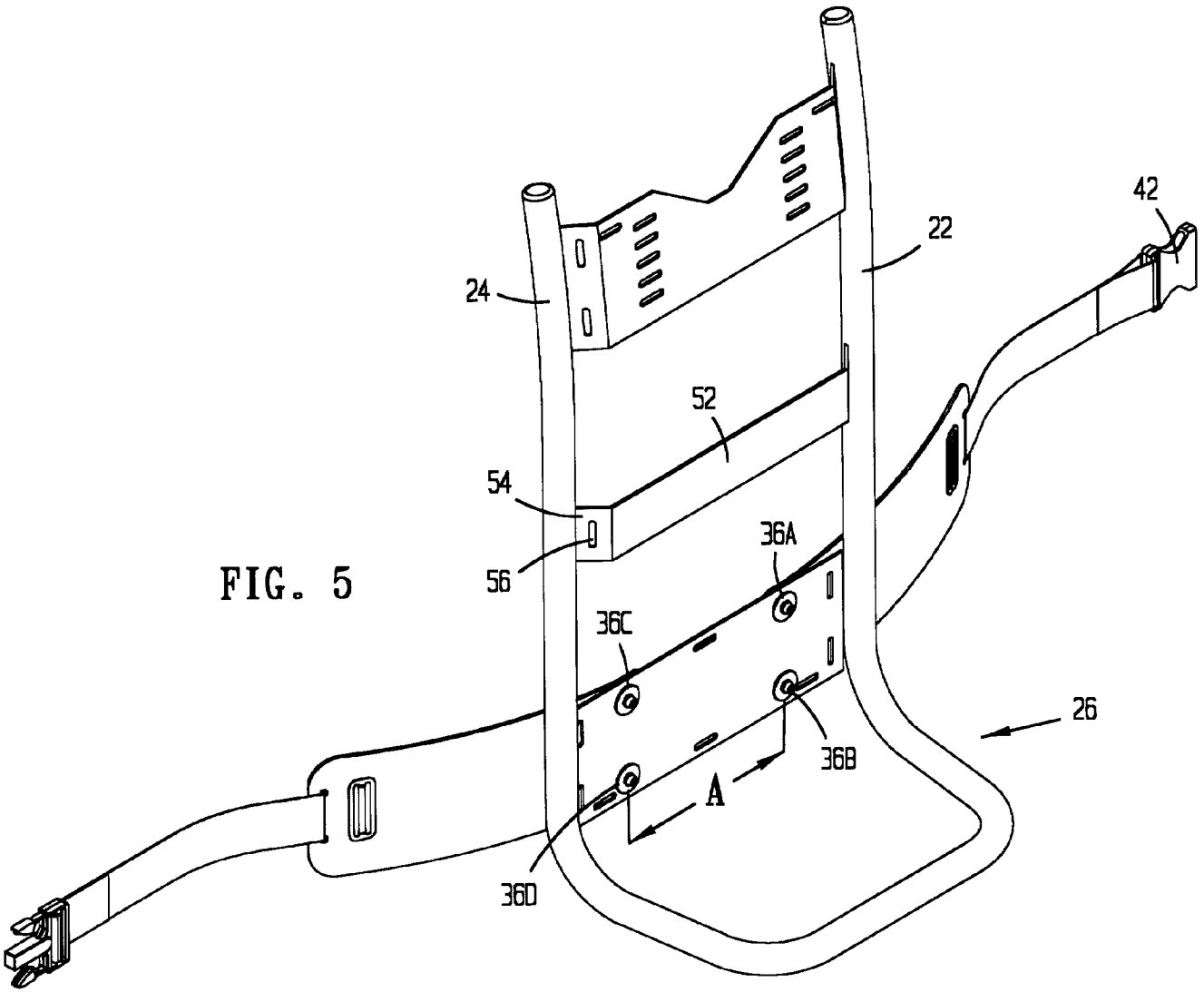
FIG. 5 is a perspective view of the external frame backpack showing the reverse view of the frame of FIG. 2.

Applicant has also found it is preferable that the separation A (See FIG. 5) is no greater than about 9 inches. It may be appreciated that slight variations of the spacing dimensions are contemplated. Note that if only a single fastener 36 is used to fasten belt 40 to hip plate 30 (or used to fasten respective hip wings 44, 46), the hip belt 40 would tend to rotate causing imbalance together with sagging or slipping of backpack upon the user. Thus, it is an important feature to include two vertically separated apertures (such as 31*a* and 31*b*) wherein the hip belt 40 may be rigidly fastened to the hip plate 30 at the two apertures (i.e. 31*a* and 31*b*). Preferably, two fasteners 36 are positioned through the vertically separated apertures for rigid fastening of hip belt 40 to hip plate 30.

Hip belt 40 may include strap 41 which in turn includes buckle 42. Buckle 42 may include a female component which mates with the corresponding male component to buckle and accommodate tightening of hip belt 40 about the waist of a user. Such buckling may accommodate tightening and adjustment in a conventional manner.

In operation, hip belt 40 is fastened around the waist of a user. Since belt wings 44 and 46 are separated, hip belt 40 may be solidly tightened about the waist of a user to accommodate for snug yet comfortable attachment. Such separation reduces the tendency to over tighten the hip belt 40. Since hip wings 44, 46 are rigidly fastened to hip plate, the backpack 20 will tend not to sag or slip about the hips of the user. Moreover, since belt wings 44 and 46 are separated as shown, belt 40 may be tightened greater than would otherwise occur if belt 40 were a single piece or fastened to backpack 20 at a single location.

Since hip plate 30 is made of substantially rigid material, preferably aircraft grade aluminum, it will resist deformity, in turn minimizing movement or sliding of the hip belt 40 about a user. Because backpack 20 will not slide downward upon the user's hips, the shoulder straps 50 will be comfortably adjusted about the shoulders of the user and will not subsequently increase in tension to thereby gouge the shoulders of the user. In operation, the shoulder straps will be utilized primarily to stabilize the backpack 20 as opposed to a more strenuous weight supporting function.

Figure 2:
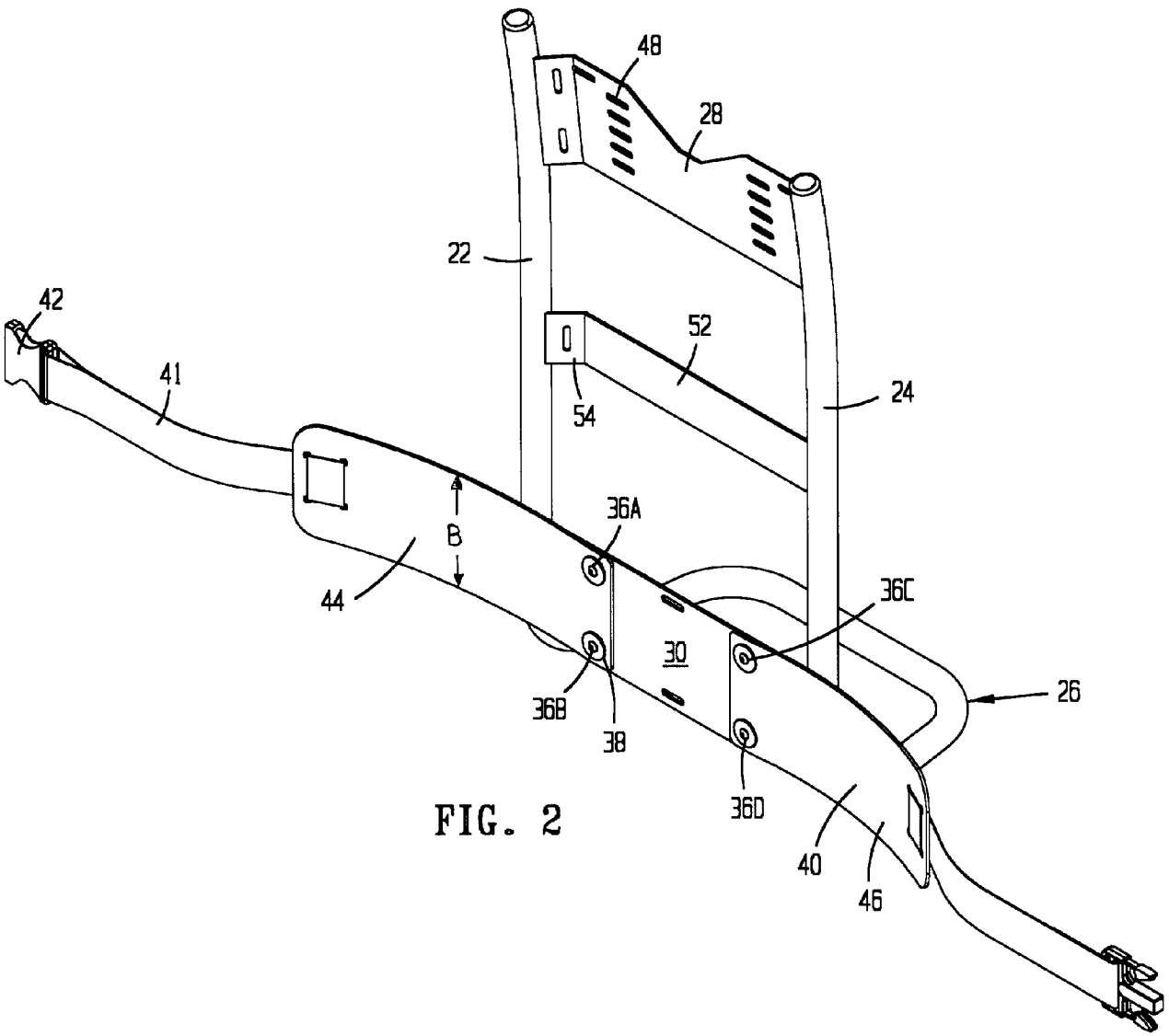
FIG. 2 is a perspective view of the external frame backpack of the present invention having attached hip belt wings.

Further as shown in FIG. 1, hip plate 30 includes apertures 31*a–d* to accommodate receipt of fasteners 36*a–d* respectively. Hip plate 30 includes various other openings to accommodate for attachment of accessories or load items. Further as shown in FIG. 2, hip belt 40 is vertically rigidly attached to hip plate 30.

Figure 3:
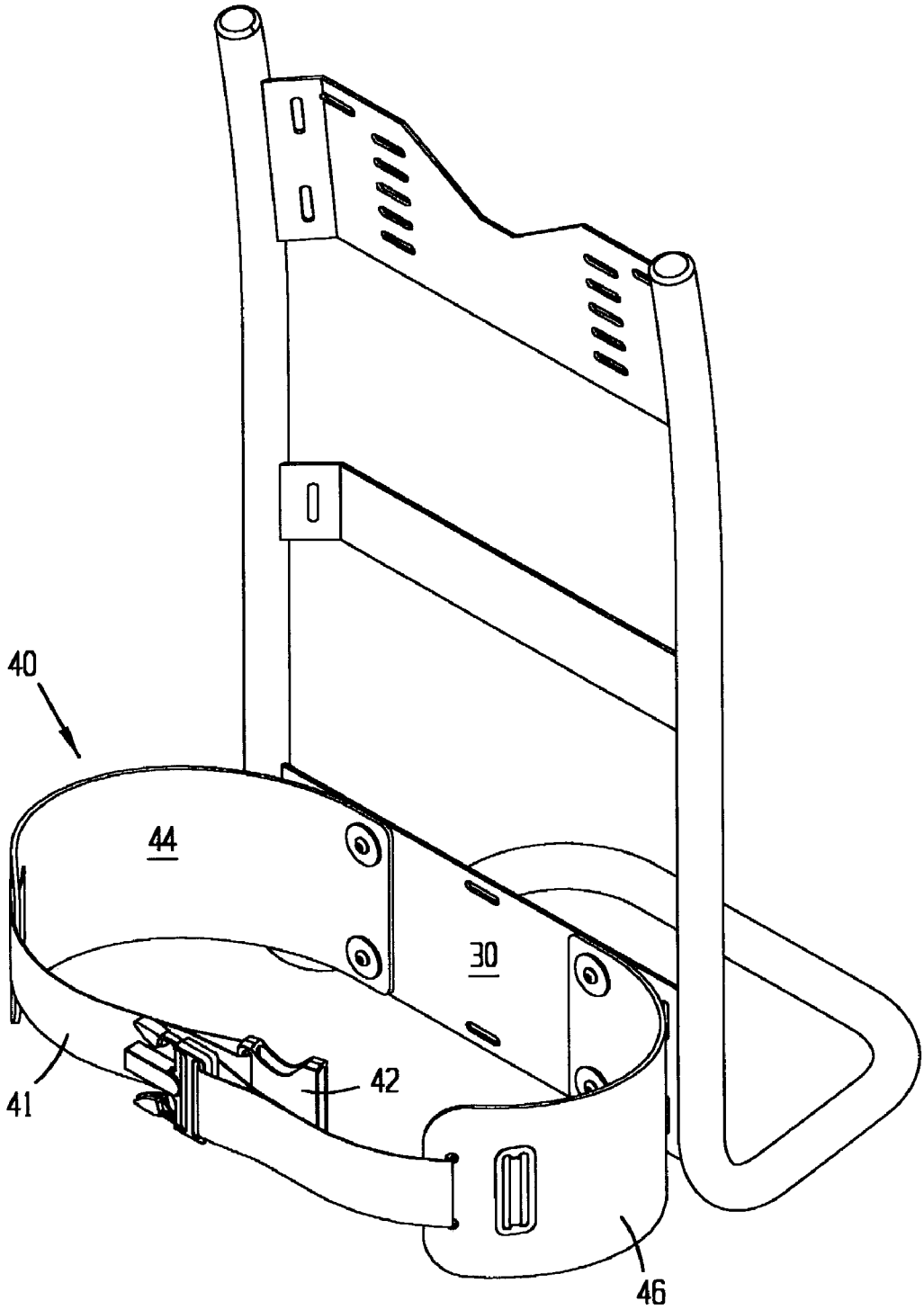
FIG. 3 is a perspective view of the backpack shown in FIG. 2 having hip belt wings configured for buckling.

As shown in FIG. 3, hip belt 40 flexes or bends away from hip plate 30 in order to wrap around the waist of a user. The vertically rigid attachment of hip belt 40 to hip plate 30 obviates sag of backpack 20 upon the user.

Figure 4:
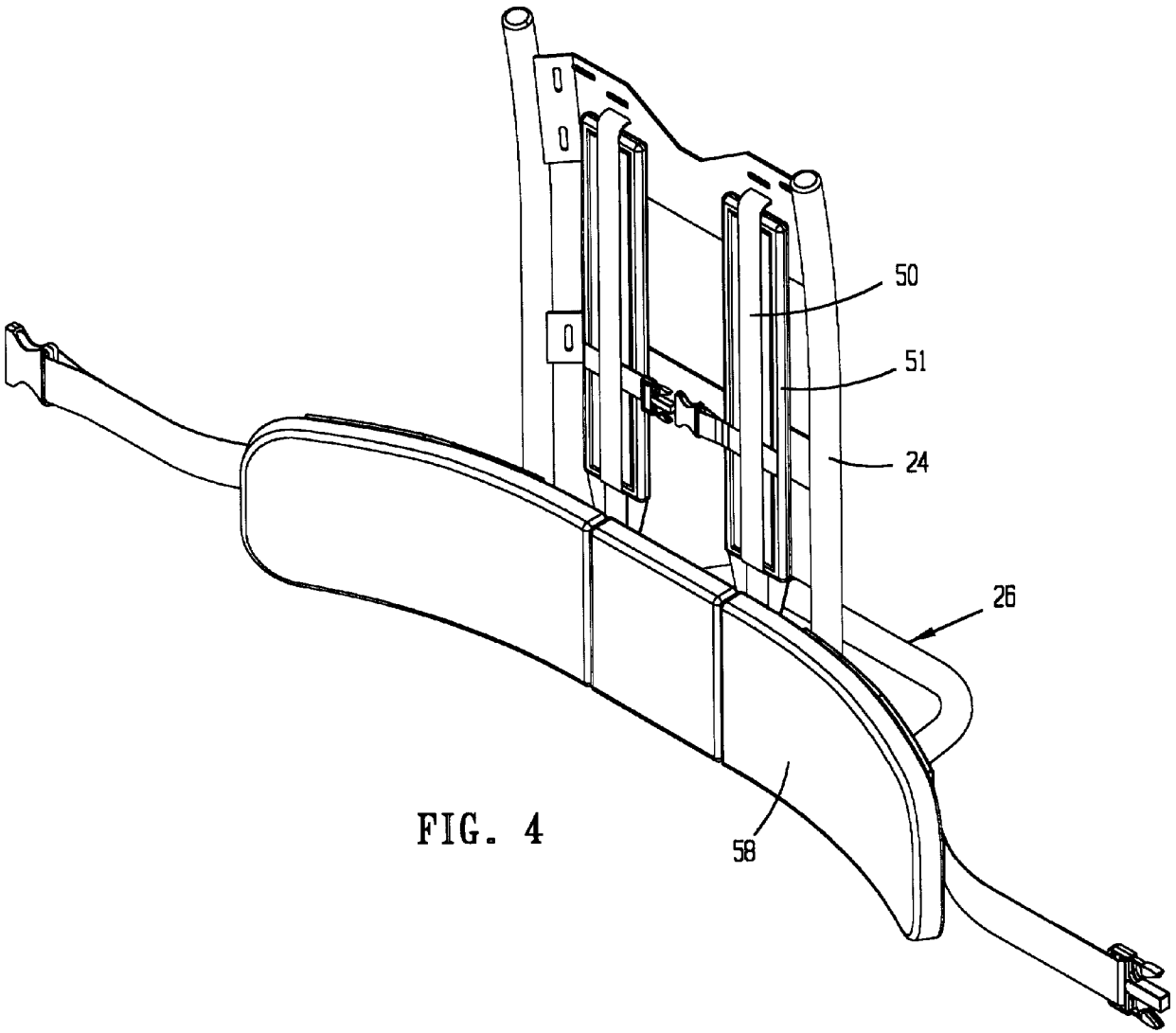
FIG. 4 is a perspective view of the external frame backpack of the present invention having a hip pad included with a hip belt and attached shoulder straps.

As shown in FIG. 4, hip pad 58 is secured to hip belt 40. In operation, hip pad 58 is not weight or load bearing and instead functions only as a pad between the hips of the user and the hip belt wings 44 and 46. Thus, hip pad 58 is isolated from weight bearing load. Isolating hip pad 58 from load bearing forces results in comfortable use of backpack 20. Together with aforementioned hip belt fastening construction, use of an isolated hip pad 58 results in a comfortable and secure load transfer to the hips while minimizing sagging.

Figure 6:
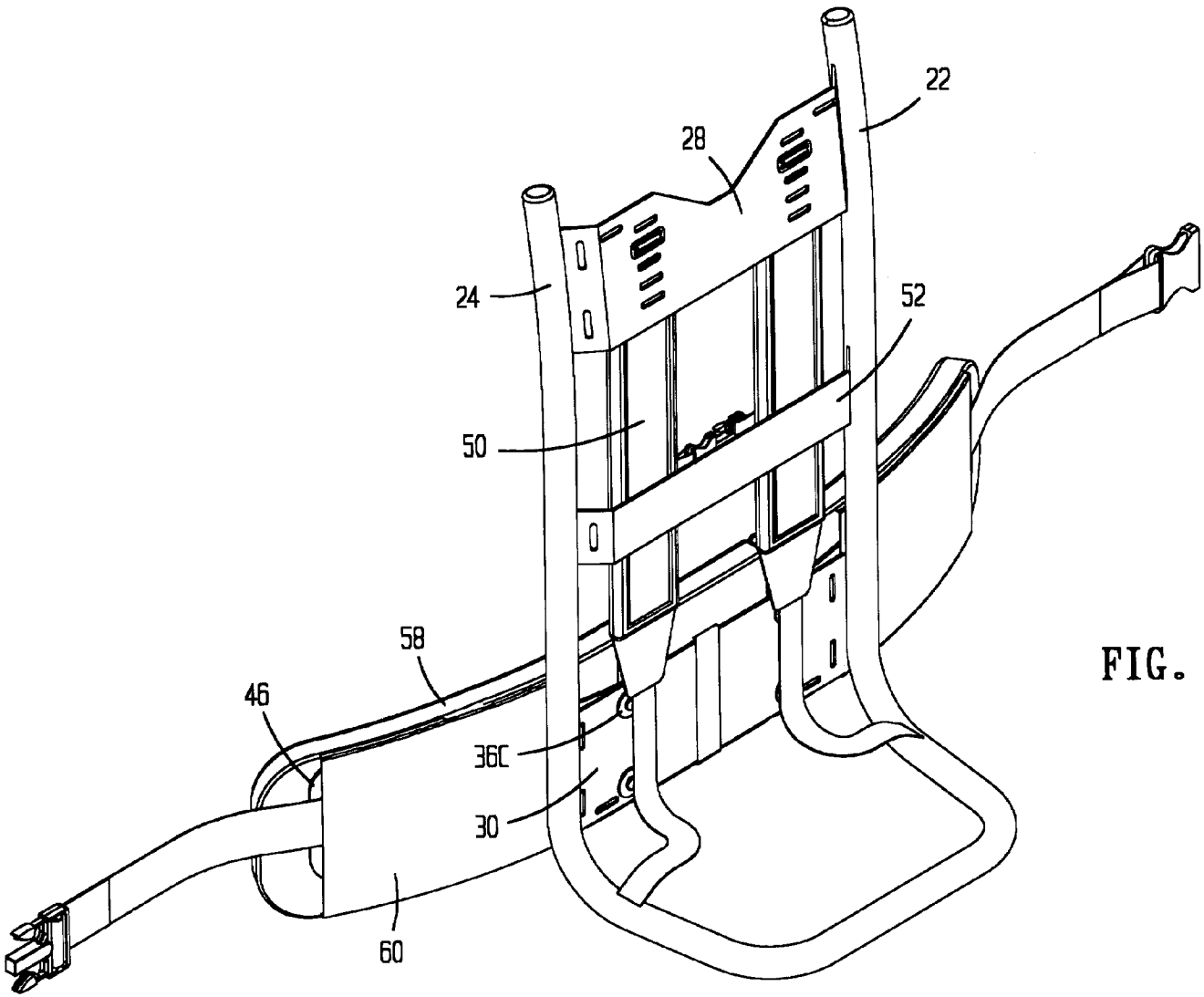
FIG. 6 is a perspective view of the external frame backpack showing the reverse view of the frame of FIG. 4.

Hip pad 58 includes pad sleeve 60 (See FIG. 6) which accommodates for areas of insertion of hip pad 58 upon hip belt 40.

Preferably, the hip belt 40, or each of the hip wings 44, 46, as the case may be, is fastened to the hip plate 30 through at least two vertically separated apertures 31*a* and 31*b* defined by the hip plate 30. Apertures 31*c* and 31*d* are preferably used for fastening right hip wing 46. It may be appreciated that additional apertures 31 may be included to accommodate various vertical attachments for the hip belt 40. Apertures 31 should be vertically separated so as accommodate a hip belt which is vertically-rigidly fastened to the hip plate 30. Such attachment resists vertical deformation of the hip belt, yet allows for horizontal flexibility so that the hip belt may be wrapped about the hips of the user. Preferably, the apertures 31 are spaced vertically apart so as to align toward the top and bottom edges of the hip belt 40. Fastening may occur by use of a single fastener (i.e., similar to use of a staple, not shown) inserted into each of the separated apertures or with more than one fastener, each inserted into the respective vertically separated apertures. If a single aperture 31 were used for fastening, the hip belt 40 would tend to rotate, thus resulting in potential for sagging and unstable handling of backpack 20.

Straps 50 are positioned upon backpack 20 generally linearly at slots 48 to the bottom portion 20. Shoulder pads 51 are preferably of greater width than the shoulder straps 50. Because the shoulder pads 51 are secured with relatively thin straps 50, as compared to shoulder pads 51, this allows some rotation of the shoulder pad 51 to follow the contour around the neck and shoulder of a user while allowing the full width of the shoulder pad 51 to disperse weight.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

I claim:

1. An external frame backpack comprising:

two spaced-apart substantially rigid frame side posts;

a substantially rigid cargo shelf integrally connected to said two side posts;

a substantially rigid upper cross member secured between said side posts;

a substantially rigid lower hip plate secured to and spanning between said side posts; and a flexible hip belt rigidly fastened to said hip plate at a position not beyond said side posts, said hip belt fastened to said hip plate with at least a first set of substantially vertically aligned fasteners.

2. The backpack of claim 1 wherein said hip plate includes an upper edge portion and a lower edge portion.

3. The backpack of claim 2 wherein at least one of said fasteners is fastened adjacent said upper edge portion and at least another of said fasteners is fastened adjacent said lower edge portion.

4. The backpack of claim 1 wherein said hip plate is generally rectangular and defines at least two vertically separated apertures, and wherein said hip belt is rigidly fastened to said hip plate at said two apertures.

5. The backpack of claim 1 wherein each of said fasteners includes one selected from the group consisting of a bolt and a rivet.

6. The backpack of claim 1 wherein said at least two fasteners are positioned vertically.

7. The backpack of claim 1 wherein said hip belt is fastened to said hip plate with at least said a first set and a second set of substantially vertically aligned fasteners, said hip belt having a left hip wing and a right hip wing.

8. The backpack of claim 7 wherein each of said fasteners includes one selected from the group consisting of a bolt and a rivet.

9. The backpack of claim 7 wherein said first set of fasteners is fastened at least about 6 inches from said second set of fasteners.

10. The backpack of claim 7 wherein said first set of fasteners is fastened at least 7 inches from said second set of fasteners.

11. The backpack of claim 7 wherein said first set of fasteners is fastened no greater than about 9 inches from said second set of fasteners.

12. The backpack of claim 1 wherein said upper cross member includes slots for receiving shoulder straps.

13. The backpack of claim 1 wherein said hip plate is non-curved and is welded between said side posts.

14. The backpack of claim 1 wherein said hip plate defines a hip plate plane extending substantially between said side posts.

15. The backpack of claim 14 wherein said upper cross member defines an upper cross member plane offset from said hip plate plane defined by said hip plate.

16. The backpack of claim 15 wherein said upper cross member includes an upper cross member flange.

17. The backpack of claim 15 wherein said backpack includes a middle cross member defining a middle cross member plane offset from said hip plate plane and offset from said upper cross member plane.

18. An external frame backpack for use in carrying heavy loads during which said backpack is secured about the hips and over the shoulders of a user and is subjected to movement forces about the hips and over the shoulders in relation to the motion of the user, said backpack comprising:

two spaced-apart substantially rigid frame side posts;

a substantially rigid upper cross member secured between said side posts;

a substantially rigid lower hip plate secured to and spanning between said side posts; and a hip belt rigidly fastened to said hip plate at a position not beyond said side posts, said hip belt fastened to said hip plate with at least a first set of substantially vertically aligned fasteners;

whereby during the user motion sagging of said backpack about the hips is obviated due to said hip belt being rigidly fastened to said hip plate thereby contributing to obviating sagging of said backpack and corresponding shoulder strap gouging.

19. The backpack according to claim 18 wherein said lower hip plate is generally rectangular and includes an upper edge portion and a lower edge portion, at least one of said fasteners fastened to said hip plate at said upper edge portion and at least another of said fasteners fastened to said hip plate at said lower edge portion.

20. The backpack according to claim 19 wherein said hip belt is rigidly fastened to said hip plate with at least said a first set and a second set of substantially vertically aligned fasteners, and wherein said hip belt includes a left hip wing and a right hip wing.

21. The backpack of claim 20 wherein said fasteners of said first set are fastened at least about 7 inches from said second set.

22. An external frame backpack comprising:

two spaced-apart substantially rigid frame side posts;

a substantially rigid upper cross member secured between said side posts;

a substantially rigid lower hip plate secured to and spanning between said side posts; and a flexible hip belt rigidly fastened to said hip plate at a position not beyond said side posts, said hip belt fastened to said hip plate with a first fastener and a second fastener, said first fastener position at least about 6 inches from said second fastener.

23. The backpack of claim 22 wherein said first fastener is positioned at least about 7 inches from said second fastener.

24. The backpack of claim 22 wherein said first fastener is positioned no greater than about 9 inches from said second fastener.

25. The backpack of claim 22 wherein said first and said second fasteners each include a set of substantially vertically aligned fasteners.

* * * * *